US011029630B2

(12) United States Patent
Hirst

(10) Patent No.: US 11,029,630 B2
(45) Date of Patent: Jun. 8, 2021

(54) FUSER UNIT HEATER SUPPORT

(71) Applicant: HEWLETT-PACKARD DEVELOPMENT COMPANY, L.P., Spring, TX (US)

(72) Inventor: Bartley Mark Hirst, Boise, ID (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/603,389

(22) PCT Filed: Sep. 18, 2017

(86) PCT No.: PCT/US2017/052026

§ 371 (c)(1),
(2) Date: Oct. 7, 2019

(87) PCT Pub. No.: WO2019/055044

PCT Pub. Date: Mar. 21, 2019

(65) Prior Publication Data

US 2021/0088951 A1 Mar. 25, 2021

(51) Int. Cl.
*G03G 15/20* (2006.01)

(52) U.S. Cl.
CPC ..... *G03G 15/2053* (2013.01); *G03G 15/2064* (2013.01)

(58) Field of Classification Search
CPC ..... G03G 15/2017; G03G 15/2053; G03G 15/2064
See application file for complete search history.

(56) References Cited

U.S. PATENT DOCUMENTS

| | | | | |
|---|---|---|---|---|
| 5,887,238 | A | 5/1999 | Matsuzoe et al. | |
| 6,940,044 | B2 | 9/2005 | Eskey et al. | |
| 8,150,305 | B2 | 4/2012 | Shin | |
| 8,452,218 | B2 | 5/2013 | Fujiwara et al. | |
| 8,472,835 | B2 | 6/2013 | Suzuki et al. | |
| 9,026,025 | B2 | 5/2015 | Mimbu et al. | |
| 9,551,963 | B2 | 1/2017 | Tada et al. | |
| 2004/0062578 | A1 | 4/2004 | Kim et al. | |
| 2008/0304882 | A1* | 12/2008 | Shin | G03G 15/2053 399/329 |
| 2010/0290822 | A1 | 11/2010 | Hasegawa et al. | |
| 2011/0021714 | A1* | 1/2011 | Gilmartin | G03G 15/2053 525/340 |
| 2011/0158718 | A1* | 6/2011 | Fujiwara | G03G 15/2053 399/329 |
| 2011/0170920 | A1 | 7/2011 | Fujiwara et al. | |
| 2011/0222931 | A1 | 9/2011 | Shinshi et al. | |
| 2013/0026154 | A1* | 1/2013 | Taniguchi | G03G 15/2053 219/385 |
| 2014/0161500 | A1 | 6/2014 | Kataoka et al. | |
| 2015/0055993 | A1* | 2/2015 | Shoji | G03G 15/2053 399/329 |

(Continued)

FOREIGN PATENT DOCUMENTS

| | | | |
|---|---|---|---|
| JP | 2013015661 | A | 1/2013 |
| JP | 2016020987 | A | 2/2016 |

*Primary Examiner* — Sophia S Chen
(74) *Attorney, Agent, or Firm* — Fabian VanCott

(57) ABSTRACT

A support of a heater in a fuser, the support including: two parallel sides and a back side, the three sides forming a U shaped cross section, the cross section having a non-uniform wall thickness.

20 Claims, 5 Drawing Sheets

(56) References Cited

U.S. PATENT DOCUMENTS

| | | | | |
|---|---|---|---|---|
| 2015/0168892 | A1* | 6/2015 | Kuroda | G03G 15/2053 399/329 |
| 2016/0091852 | A1 | 3/2016 | Matsuno et al. | |
| 2016/0299461 | A1 | 10/2016 | Buchanna | |
| 2017/0102650 | A1 | 4/2017 | Shimura et al. | |

* cited by examiner

FUSER UNIT HEATER SUPPORT

BACKGROUND

Printers are optimized based on a variety of performance characteristics. These include cost, printing speed, dots per inch, time to first page, and energy efficiency. These characteristics may be assessed in a variety of ways and may be considered on an overall or per printed page basis.

BRIEF DESCRIPTION OF THE DRAWINGS

The accompanying drawings illustrate various examples of the principles described herein and are a part of the specification. The illustrated examples do not limit the scope of the claims.

Figure 1:
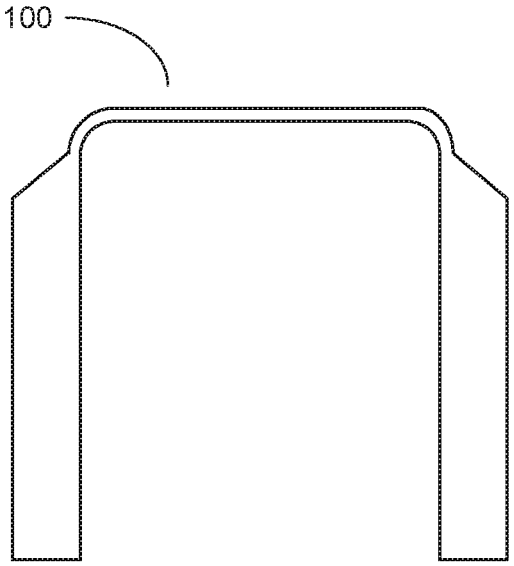
FIG. 1 shows a cross sectional view of an example of a support for a fuser unit heater according to one example consistent with this specification.

Throughout the drawings, identical reference numbers designate similar, but not necessarily identical, elements. The figures are not necessarily to scale, and the size of some parts may be exaggerated to more clearly illustrate the example shown. Moreover the drawings provide examples and/or implementations consistent with the description; however, the description is not limited to the examples and/or implementations provided in the drawings.

DETAILED DESCRIPTION

Printers are evaluated on a variety of parameters. One parameter of concern is energy efficiency. Energy efficiency is assessed both overall and on a per page basis. In assessing energy efficiency, it is useful to model the use of the printer. Commercial printers, for example, those used by print shops are generally run nearly continuously. This limits the energy cost of startup and idle operations. Continuous use also allows effective use of the equipment.

Printers for business and personal use, in contrast, are generally used for occasional, smaller jobs. This use pattern impacts the energy efficiency of the printer. For example, the amount of energy expended to keep the printer ready has increasing impact as the printer spends a high percentage of the time waiting for a job rather than printing. Since jobs are often separated by downtime, the energy cost to transition from a standby state to an active state has a larger impact as most jobs will involve transitioning the printer from standby to printing, printing the job, and returning the printer to standby.

Excellent advances have been made in printer design to reduce the energy usage in standby state, reduce the time to prepare a printer for printing, reduce the time to print the first page of material, and cost. The inventor has noted that for business or personal printing, some system components never reach equilibrium (or steady state operating conditions). Further, it is possible to design components to take longer or shorter times to reach steady state conditions. If the component is an energy drain on the system, then slowing the component's time to steady state can reduce the energy used on small jobs. Basically, the system can run the job before the component reaches steady state. Reducing the total amount of energy to get a component to steady state also reduces the energy consumption of the system. Examples of both of these principles are applied herein to reduce the energy losses associated with a support for the heater in a fuser.

A fuser provides heat and pressure to convert toner deposited on a media into a stable form. The media and toner are passed through an area called the nip. The nip is located between a pressure roller and the heater. The toner is heated and pressed into and around the fibers of the media in the nip. Once clear of the nip, the toner cools and solidifies in and around the fibers of the media, producing a stable printed image on the media.

A fuser uses a fuser sleeve surrounding the heater. The fuser sleeve rotates with the pressure roller. The heater provides heat into the fuser sleeve. The fuser sleeve heats to an operating temperature on the outside surface, e.g., the nip side of the fuser sleeve. There the fuser sleeve provides the heat needed to fuse the toner in the nip.

An energy balance exists between the fuser sleeve and its surroundings. The fuser sleeve receives heat from the heater and provides heat to the nip and also to the surroundings. Energy provided to the surroundings is generally lost.

However, the fuser sleeve also provides energy to elements within the fuser sleeve. These include the heater and also a support. The support provides rigidity and strength to provide the pressure profile across the nip with the pressure roller. Without the support, the heater and fuser sleeve would bend away from the pressure roller, producing uneven pressure, incomplete fusing, and unacceptable performance.

The inventor recognized that the surroundings included elements inside the fuser sleeve. That is to say, the energy balance includes the energy lost to heating the support to a steady state temperature. Steel which is used for its strength and cost has a high absorbance and high heat capacity. Accordingly, during warmup and use, a steel support absorbs heat until the support reaches steady state. At steady state, the heat absorbed by the support equals the heat expelled from the support, There are some, small contributions from convection and the air inside the fuser sleeve, however most of this heat exchange is by radiation.

Reducing the heat capacity of the support reduces the amount of energy wasted on heating the support to steady state temperature. A thinner support has less mass and less heat capacity. However, the wall thickness of the support is constrained by the stiffness to provide the desired pressure in the nip. The support is designed to provide adequate reactive force against the pressure roller in order to have a nip with an acceptable pressure profile.

However, not all portions of the support contribute equally to the stiffness of the support. For example, the side walls of the support, e.g., those perpendicular to the nip, provide greater stiffness on a per unit mass basis. In contrast, the back wall provides less stiffness on a per unit mass basis. Accordingly, by using a non-uniform wall thickness, the mass can be optimized to provide the desired stiffness with less overall mass and thus less heat capacity. Reducing the heat capacity reduces the energy used to heat the support to steady state temperature. This also reduces the time to heat the fuser sleeve to operating temperature, as less heat is diverted to heating up the support.

Other methods of optimizing the stiffness of the support while reducing the mass may be employed. These include using openings in the support. For example, the support may include a trestle design on the sides with openings on the top. This approach takes advantage of the non-linear behavior of the stiffness, Again the goal being to provide the desired support to the nip while minimizing the heat capacity of the support.

While experimenting to optimize stiffness to heat capacity of the support member, the inventor noticed that for representative consumer print jobs, the support did not always reach steady state. This produced the recognition that at steady state the amount of heat absorbed was the heat capacity of the support multiplied by the difference between the steady state temperature and the start temperature. In contrast, if the support never reached steady state, then the heat absorbed was dependent on the final temperature. Further, by slowing the absorption of heat by the support, the final temperature could be reduced resulting in less energy wasted in heating the support.

A prototype support made of aluminum showed a much larger reduction in absorbed heat than predicted based on the heat capacity of the support. Instead, the aluminum reflected the emitted thermal radiation from the inside of the fuser sleeve and absorbed less of the heat. This slowed the heating of the support relative to a steel support. As a result, the aluminum support reached a lower final temperature in a standard print job. So while less thermal mass reduced the heat loss to the support regardless of job size, for smaller jobs, the transient heating was the factor that impacted energy use. By reflecting the heat back to the fuser sleeve (where the heat would be useful in heating the nip), the time to heat the fuser sleeve to operating temperature was reduced and the energy use was also reduced. Further, this energy savings was greater on smaller print jobs found in consumer and office use. For larger jobs, the transient effects disappeared as steady state defined an increasing percentage of the operating time.

The use of a low absorbance surface on the support can reduce the rate heat is absorbed by the support. The low absorbance surface may be a coating, for example a vapor deposited metal and/or a plated metal. The low absorbance surface may be provided by a film and/or similar barrier. As used in this specification and the associate claims, low absorbance indicates a surface with no greater than 20% absorbance of radiation from the inside of the fuser sleeve. Clearly, even lower absorbance offers additional benefits in reducing the rate of heat being used in heating the support. In some examples, designs may have an absorbance of less than 10%, 5%, or 3%. Or expressed in other terms, designs may have an emissivity of less than 20%, 10%, 5%, or 3%. Kirchhoff's 1859 law of thermal radiation states that for an arbitrary body emitting and absorbing thermal radiation in thermodynamic equilibrium, the emissivity is equal to the absorptivity. Both absorptivity and emissivity are expressed as the percentage of a black body at the same temperature and wavelength. There is a balance in cost, energy savings, robustness, and other design criteria that will impact which choice is best for a given printer design.

As used in this specification and the associated claims the term "substantially" should be interpreted to imply + or −10% of the value unless specifically stated otherwise. For geometric terms, such as substantially parallel, this implies up to 10% deviation from parallel, that is 10% of 90 degrees, i.e., +/−9 degrees with respect to each other).

Accordingly, this specification describes a number of approaches to minimize the transient and steady state heat losses associated with heating the support member for the heater in a fusing unit. The described approaches may be used individually or in combination. The described approaches will also be balance against other design criteria including cost and/or reliability.

Among other examples, this specification describes a support of a heater in a fuser, the support including: two parallel sides and a back side, the three sides forming a U shaped cross section, the cross section having a non-uniform wall thickness.

This specification also describes a fuser, the fuser including: a support having two substantially parallel sides extending away from a fusing nip, the support including a first material as a substrate and a second material on a surface of the support, the second material having a lower emissivity than the first material.

This specification also describes a fuser including: a support including: two substantially parallel sides extending away from a nip, and a back side connecting the two substantially parallel sides, the three sides each having: a substrate with a first emissivity, and a surface with a second emissivity, wherein the first emissivity is greater than the second emissivity, and wherein a wall thickness of the back side is less than a wall thickness of the two substantially parallel sides. In another example, the wall thickness of the back side is greater than a wall thickness of one and/or both of the two substantially parallel sides.

Turning now to the figures, FIG. 1 shows a cross sectional view of an example of a support (100) for a fuser unit heater according to one example consistent with this specification. The support (100) includes: two parallel sides and a back side, the three sides forming a U shaped cross section, the cross section having a non-uniform wall thickness.

Using a non-uniform wall thickness allows the support (100) to provide the desired stiffness while reducing the heat capacity of the support (100). The wall thickness of the back side is less than a wall thickness of one of the parallel sides. The wall thicknesses of the parallel sides may be the same. The wall thickness of the parallel sides may be different.

In some examples, openings and/or areas of reduced thickness are produced in one or more of the three sides. Such openings reduce the heat capacity of the support (100). Similarly, thinned areas may reduce the heat capacity of the support (100). The back side of the support (100) may include an opening. The back side of the support (100) may include localized areas of thinning. The back side of the support (100) may be uniformly reduced in wall thickness compared with a wall thickness of another side of the support (100).

Either or both of the parallel sides of the support (100) may include an opening. Either or both of the parallel sides of the support (100) may include an area of reduced wall thickness. The parallel sides of the support (100) may be trestle-like to increase a ratio of stiffness to mass for the support (100). Increasing mass correlates with increasing heat capacity in a given material.

A volume between the two parallel sides of the support (100) may be occupied by an insulating material. For example, a foam and/or similar material may be used to increase the stiffness of the support (100). Foams can provide stiffness and insulation with minimal increase in mass and/or heat capacity. The outer surface of the support (100) can also be covered with an insulator. This will allow the outer surface of the support (100) to heat to temperature while slowing the transmission of heat into the support (100). The outer insulation may conform to the support (100). The outer insulation may conform to the shape of the fuser sleeve, with a gap sufficient to prevent contact (and friction) between the fuser sleeve and the insulation.

A surface of the support (100) may be coated with a coating having an emissivity of no more than 20%. The outer surface of the support (100) may be coated. The coating may be applied to just the back of the back side of the support (100). That is to say, the side away from the nip. The coating may be applied to all surface of the support (100). This may be an effective option with plating and/or a similar coating. For vapor deposited coatings, it may be more economical to coat just the outside of the support (100) and to not coat the inside of the support (100), that is, the surface toward the heater and the nip. In some heater designs, the inside of the support (100) is shielded by the parts of the heater such that the inside of the support (100) does not have much heat applied to the interior surface of the support (100). In other designs, for example, using older style bulb heaters, coating both the inside and the outside of the support (100) may be more effective to reduce the amount of energy absorbed by the support (100).

Figure 2:
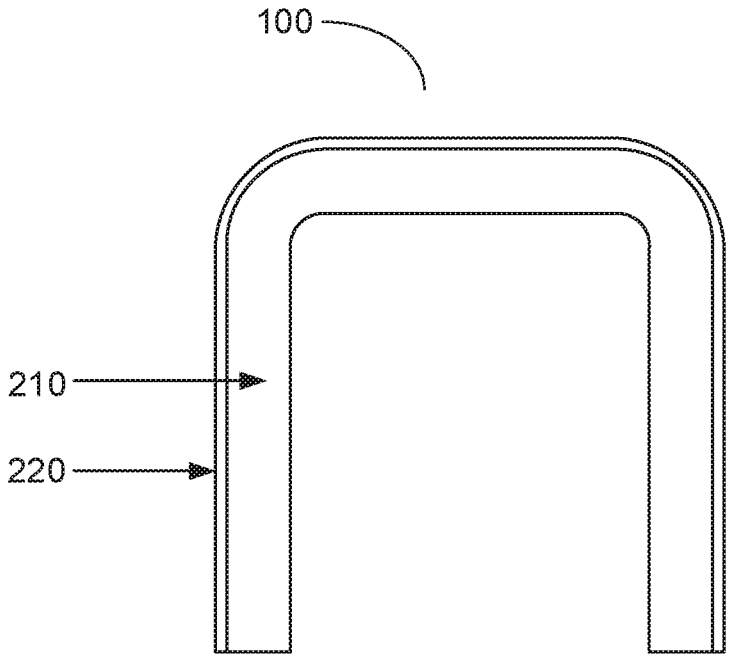
FIG. 2 shows a cross sectional view of an example of a support for a fuser unit heater according to one example consistent with this specification.

FIG. 2 shows a cross sectional view of an example of a support (100) for a fuser unit heater according to one example consistent with this specification. The support (100) has two substantially parallel sides extending away from a fusing nip, the support (100) has a first material as a substrate (210) and a second material on a surface (220) of the support (100), the second material having a lower emissivity than the first material.

The substrate (210) may be a steel, such as a low carbon steel. The substrate (210) may be metal with a high strength to weight ratio, for example aluminum and/or titanium. The substrate (210) may include a structural polymer and/or a composite. As stiffness is more relevant in the axis perpendicular to the flow of media through the nip, materials with heterogeneous properties, such as composites may provide additional options in reducing the total heat capacity of the support (100).

The two substantially parallel sides may be connected by a back side which is perpendicular to the two substantially parallel sides. The two substantially parallel sides may be joined by an insulator, such as a foam, between the two parallel sides.

The second material may be a plated metal coating. The plated metal coating may be nickel, such as Wood's nickel. In another example, a precious metal may be used such as copper and/or silver. The plated metal may be a refractory metal such as molybdenum. The plated metal may be aluminum. When selecting plated coatings, it is desirable to have a coating with a low emissivity, preferably below 20%, 10%, 5%, or 3%. For example, platinum can be plated as platinum black as well as a bright deposit. Selecting a low emissivity deposit reduces the rate at which the support (100) heats up and the thus reduces the total amount of heat absorbed by the support (100) during small print jobs. In contrast, selecting a coating like platinum black would increase the rate of absorption of heat, producing greater energy usage and longer time to first page. A bright nickel plated steel prototype support demonstrated reduced energy consumption compared with an unplated steel support control in testing. The prototype also showed reduced time to first page compared with the unplated control, reflecting greater efficiency in heating the fuser sleeve with less energy being lost to heat the support.

Since the coating is primarily to prevent absorption of heat (there is no visible light and/or UV being emitted by the fuser sleeve), the thickness of the coating can be quite thin compared with plated coatings for corrosion resistance and/or mechanical protection. In some cases, it is feasible to use just a strike and/or a similar thin coating rather than a strike and plate approach used to deposit thicker plated deposits.

Another approach to applying a low emissivity coating is vapor deposition. Vapor deposition can apply thin, conformal layers of metal to substrates. Vapor deposition may be a line of sight process that makes deposition on all sides of the support more challenging. On the other hand, the ability to deposit bright coatings with low emissivity is readily accomplished by vapor deposition. Physical vapor deposition techniques are widely available.

A physical vapor deposited coating with a low emissivity may be produced using a variety of metals including but not limited to: silver, copper, chrome, aluminum, and/or nickel.

Another approach for modifying the surface emissivity of a support (100) is to wrap the support (100) using a foil. For example, aluminum foil may be wrapped over the outer surface of the support (100). The ends of the foil may be tucked under the interface between the support (100) and a plate supporting the nip in order to hold the foil in place. The foil may also cover the interior surface of the support. A metalized polymer film can be applied to surface of the support. For example, a metalized Mylar can be wrapped around the outer surface of the support (100). An adhesive can be used to secure a metalized film and/or a foil to the support (100). Clearly, the adhesive would need to be able to withstand the operating temperatures of the fuser. Accordingly, crosslinking polymers (e.g. epoxies) and adhesives with thermal resistance (e.g. silicones) are useful.

Figure 3:
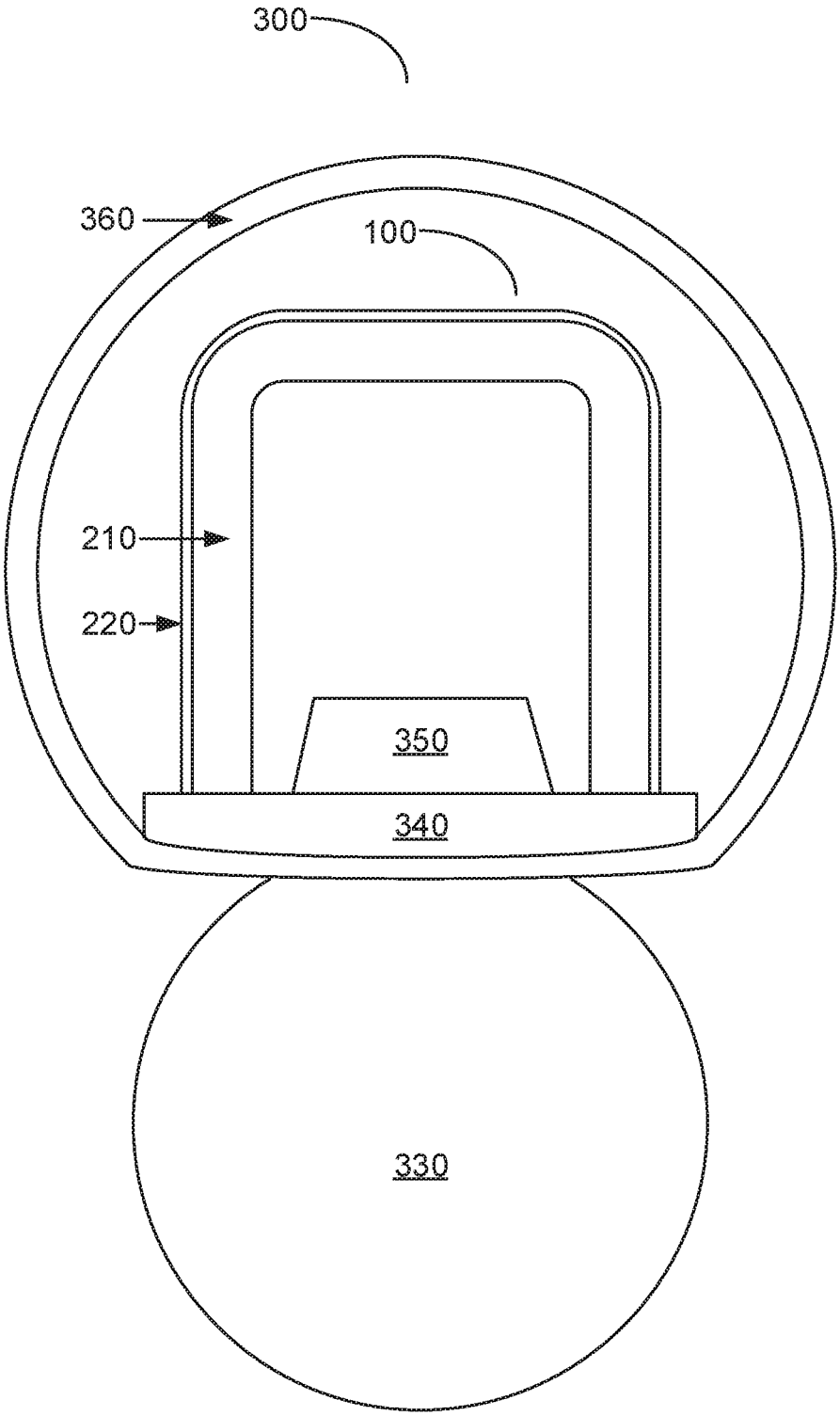
FIG. 3 shows a cross section view of a fuser with a support consistent with this specification.

FIG. 3 shows a cross section view of a fuser (300) with a support (100) consistent with this specification. The support includes a substrate (210) and an outer surface (220) with a lower emissivity than the substrate (210). The support covers a heater (350) which, along with the support, is mounted on a plate (340). The plate (340) may be fabricated from an alumina ceramic and/or a nitrided alumina ceramic. Nitrided alumina ceramics may provide lower thermal expansion compared with alternate materials. The ceramic plate (340) is attractive as the heater (350) can be manufactured on the ceramic using a silk screen printing process and then fired using traditional glazing techniques resulting in a very reliable resistive heating system. The plate (340) supports the fuser sleeve (360) against a pressure roller (330). The nip is located between the pressure roller (330) and the fuser sleeve (360). The heater (350) may be on the other side of the plate (340) such that the heater (350) is located between the plate (340) and the fuser sleeve (360).

Here, heat flows from the heater (350) into the fuser sleeve (360). The fuser sleeve (360) radiates heat to the support (100). The thermal radiation from the fuser sleeve (360) mostly reflects off the outer surface (220) which has been modified to have a low emissivity. This reduces the amount of heat transferred to the substrate (210) of the support (100). Instead, much of the reflected heat is reabsorbed by the interior surface of the fuser sleeve (360).

Figure 4A:
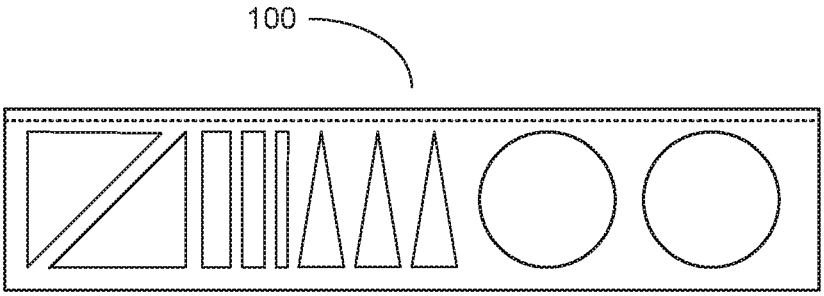
FIG. 4A shows a side view of a support for a heater in a fuser consistent with this specification.

FIG. 4A shows a side view of a support (100) for a heater (350) in a fuser (300) consistent with this specification. The sides of the support have areas removed to increase the ratio of stiffness to heat capacity of the support (100). Areas may be removed from the two parallel sides extending away from the fuser (300) nip. Areas may be removed from the back side of the support (100). A wide variety of shapes and designs can be used while still providing an acceptable balance between stiffness and heat capacity in the support (100). Information may be included in the cutout shapes, for example, a model number and/or part number may be incorporated. In one design, the removed sections include a series of triangles, each triangle with a base along the nip facing edge of the support and an apex along the back side of the support.

Figure 4B:
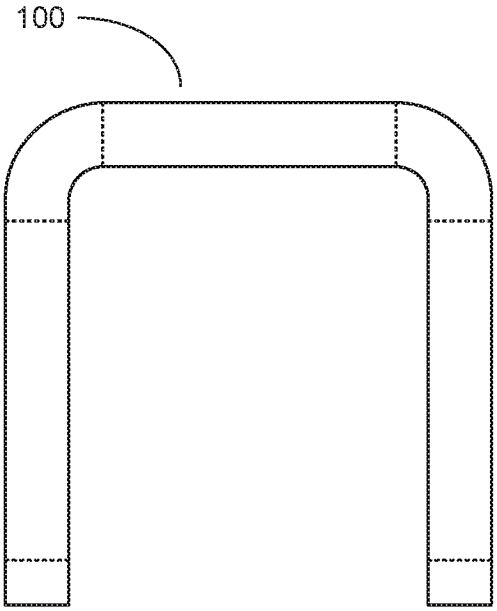
FIG. 4B shows a cross-sectional view of a support for a heater in a fuser consistent with this specification.

FIG. 4B shows a cross-sectional view of a support (100) for a heater (350) in a fuser (100) consistent with this specification. Areas well suited for removing material from the sides of the support are indicated by dotted lines on each of the sides. For example, preserving the corners of the support (100) without cutouts provides a nice balance of stiffness and heat capacity. This may also facilitate bending the support into the desired shape, for example if the cutouts are removed prior to forming the U cross-section.

Figure 5:
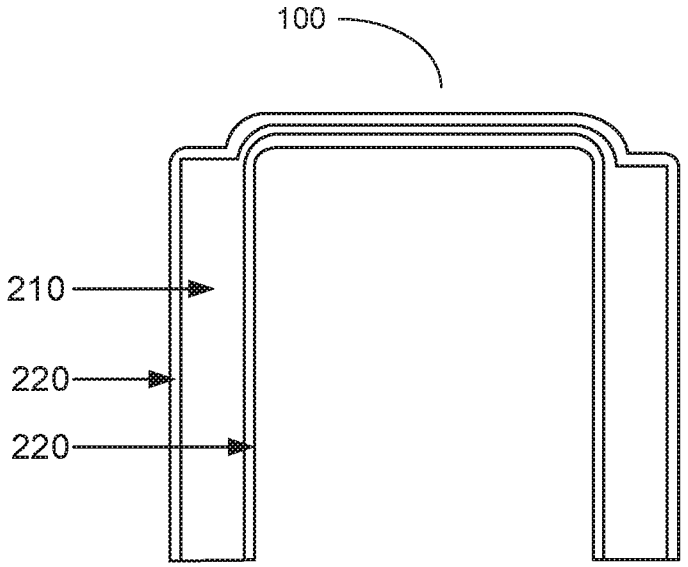
FIG. 5 shows a cross-sectional view of a support for a heater in a fuser according to one example consistent with this specification.

FIG. 5 shows a cross-sectional view of a support (100) for a heater (350) in a fuser (300) according to one example consistent with this specification, the support (100) including: two substantially parallel sides extending away from the nip, and a back side connecting the two substantially parallel sides, the three sides each including: a substrate (210) with a first emissivity, and a surface (220) with a second emissivity, wherein the first emissivity is greater than the second emissivity, and wherein a wall thickness of the back side is less than a wall thickness of the two substantially parallel sides It will be appreciated that, within the principles described by this specification, a vast number of variations exist. It should also be appreciated that the examples described are only examples, and are not intended to limit the scope, applicability, or construction of the claims in any way.

What is claimed is:

1. A support of a heater in a fuser, the support comprising:
two parallel sides and a back side, the three sides forming a U shaped cross section, the cross section having a non-uniform wall thickness in which the two parallel sides have a wall thickness along a majority of a length thereof that is greater than any wall thickness of the back side.

2. The support of claim 1, wherein the support comprises a steel.

3. The support of claim 1, wherein a wall thickness of the back side is uniform along all of the back side of the support.

4. The support of claim 1, wherein a volume between the two parallel sides is occupied by an insulating material.

5. The support of claim 1, wherein a surface of the support is covered with a material having an emissivity of less than 20%.

6. The support of claim 1, wherein the support comprises aluminum, titanium, a structural polymer or composite material.

7. The support of claim 1, further comprising an insulator covering an outer surface of the support.

8. A support of a heater in a fuser, the support comprising:
two parallel sides and a back side, the three sides forming a U shaped cross section, the cross section having a non-uniform wall thickness; and
an opening in a side, the opening reducing a heat capacity of the support.

9. The support of claim 8, wherein the opening is in the back side.

10. The support of claim 8, wherein the opening is shaped as alphanumeric information.

11. A fuser, the fuser comprising:
a support having two substantially parallel sides extending away from a fusing nip, the two sides being arranged on opposite sides of a heater, the support comprising a first material as a substrate and a second material on a surface of the support, the second material having a lower emissivity than the first material, the second material disposed on an outer surface of the two sides away from the heater.

12. The support of claim 11, wherein the two substantially parallel sides are connected by a back side, the back side perpendicular to the two substantially parallel sides.

13. The support of claim 12, wherein the first material is steel and the second material is a plated metal coating.

14. The support of claim 13, wherein the second material comprises nickel.

15. The support of claim 12, wherein the second material a vapor deposited metal.

16. The support of claim 11, further comprising an insulating material between an outside surface of the support and a fuser sleeve of the fuser.

17. The fuser of claim 11, wherein the second material comprises a metal foil disposed on the substrate of the first material.

18. The fuser of claim 17, further comprising an adhesive to secure the foil to the substrate of the first material.

19. A fuser comprising:
a fuser sleeve; and
a support within the fuser sleeve, the support comprising:
two substantially parallel sides extending away from a nip, and
a back side connecting the two substantially parallel sides, the three sides each comprising:
a substrate with a first emissivity, and
a surface with a second emissivity, wherein the first emissivity is greater than the second emissivity, and
wherein a wall thickness of the back side is less than a wall thickness of the two substantially parallel sides; and
an insulating material between an outside surface of the support and a fuser sleeve.

20. The fusing apparatus of claim 19, wherein the substrate is steel, the surface is a plated nickel coating, and the plated nickel coating has an emissivity of less than 10%.

* * * * *